United States Patent [19]

Herbst

[11] 4,102,160

[45] Jul. 25, 1978

[54] PERSONAL CLOTHES WASHBOARD DEVICE

[76] Inventor: George J. Herbst, 283 Atlantic Isle, North Miami Beach, Fla. 33160

[21] Appl. No.: 781,557

[22] Filed: Mar. 28, 1977

[51] Int. Cl.[2] ..... D06F 3/02

[52] U.S. Cl. ..... 68/229; 68/237

[58] Field of Search ..... 68/223–231, 68/233, 237, 220; 248/27.5; 4/189, 190, 185 F; 206/806, 813; 15/238, 257.05, 257.06; D7/201

[56] References Cited

U.S. PATENT DOCUMENTS

| | | | |
|---|---|---|---|
| 705,116 | 7/1902 | Murphy | 68/224 X |
| 1,506,169 | 8/1924 | Fetters | 68/223 |
| 2,000,943 | 5/1935 | Gilbert | 68/228 |
| 2,021,522 | 11/1935 | Schacht | 206/813 X |
| 2,129,079 | 9/1938 | Adams | 68/223 |
| 2,312,220 | 2/1943 | Snyder | 68/223 |
| 2,779,560 | 1/1957 | Springer | 206/813 X |
| 3,589,595 | 6/1971 | White | 206/806 X |

*Primary Examiner*—Philip R. Coe
*Attorney, Agent, or Firm*—Gustave Miller

[57] ABSTRACT

This is a washboard device intended for permanent attachment to an inner wall of a washbowl or washbasin for use in washing personal and small articles of clothing. It includes a sheet of semi-rigid material having a peelable protected adhesive back coating and a front washboard surface. The washboard surface may be corrugated with alternate rounded ridges and intervening furrows in the preferred form. Alternately, it may include any type surface having a plurality of hills and valleys, in any regular or irregular pattern or spaced dots of material on a flat surface, etc. It is made of a suitable semi-rigid material in a variety of shapes, sizes, colors and can be made to conform to any size or shape basin wall, the material being a suitable plastic such as polyurethane, polyvinyl, semi-hard rubber. The edge of the sheet is preferably feathered and may be readily installed in operative position by the average person.

1 Claim, 3 Drawing Figures

PERSONAL CLOTHES WASHBOARD DEVICE

BACKGROUND OF THE INVENTION

Washboards were quite common before the days of the automatic home and commercial clothes washing machines, and were used for rubbing the clothes, by hand, in soapy water to loosen the dirt in the clothes. With the advent of the automatic washing machine, this became almost a lost art, but personal articles of clothing, particularly intimate apparel, still continue to be washed by hand in wash basins such as bathroom handwash basins, kitchen sinks or any other basin that is available. Washboards, usually used for the family wash, were readily available for personal washing, but now are no longer seen or available.

It is much harder to do personal washing, not only in the home, but also when traveling, and this invention of a personal washboard is very useful when provided in motel and hotel washbasins by the management.

OBJECTS OF THIS INVENTION

It is the object of this invention to provide a corrugated or irregular washboard which surface is to be permanently attached in most types of washbowls and basins, such as bath room washbasins or even bathtubs, as well of kitchen sinks or any type of basin in which small articles of clothing may be washed.

A further object of this invention is to make it convenient for the average person to wash their personal and intimate clothing more conveniently, efficiently than now possible.

A further object of this invention is to provide a permanently attachable washboard surface which may be made in any convenient size and shape for attachment to any type of basin in which clothes may be personally washed in small quantities as is now customary.

Yet a further object of this invention is to provide a corrugated washboard surface to a wall of practically any type of basin without interfering in any manner with the normal use of the basin.

A still further object of this invention is to provide a washboard surface readily attachable to a washbowl wall surface to provide a very convenient and efficient washboard surface to thus greatly facilitate washing small articles of clothing therein.

Yet a further object of this invention is to provide means for converting any washbowl, normally often used for washing small articles of clothing, into a much more convenient device in which to wash small articles of clothing, by adding the washboard surface of this invention thereto.

A still further object of this invention is to provide a washboard having a low profile which is ideal for laundering of fine material without interfering with normal use of the washbasin, kitchen sink, bathtub or utility sink on which it has been installed, which does not cause any form of injury during use, such as from abrasions or otherwise, and does not retain water or soap during or after use.

A still further object of this invention is to provide a personal item washboard that conforms to the basin when applied, has a long life, and is of low unit cost, permitting widespread use in homes, hotels, motels, laundromats, athletic clubs, in military living quarters, etc.

Another object of this invention is to provide a washboard surface for a basin that may be made in various shapes, sizes and colors, so as to conform with any type of basin, and offers a wide range of market adaptability, and provides a low cost appliance with an extremely high practical value factor.

Another object of this invention is to provide a washboard surface with a high-tack adhesive back, insuring one-time permanent application and eliminating the need for storage, or possibility of loss. In providing non-obstructive application directly on basin wall, this invention provides a hard surface offering the best cleansing action of a conventional old-timer washboard and tub, with none of its cumbersome qualities or physical limitations, i.e., the washing surface does not move, does not have to be held manually in place while in use, does not require storage, is not restricted in function to coarse fabrics, can be used by children.

A still further object of this invention is to provide a washboard washing surface having a feathered edge enabling clothing being washed to slide readily onto the sheet from the basin wall without obstruction.

Yet another object of this invention is to make available to the general public a personal clothes washing appliance which in use will provide an immediate and reliable savings of energy.

Yet another object of this invention is to provide an improved washboard over that shown in the prior art, such a U.S. Pat. Nos. 219,016; 608,209; 861,497; Re. 8,844; 1,478,177; 1,809,169.

BRIEF DESCRIPTION OF THE FIGURES

With the above and other objects in view, this invention consists in the details of construction, combination and arrangement of parts hereinafter set forth, claimed and disclosed in the following drawings, in which:

DETAILED DESCRIPTION OF THE INVENTION

Figure 1:
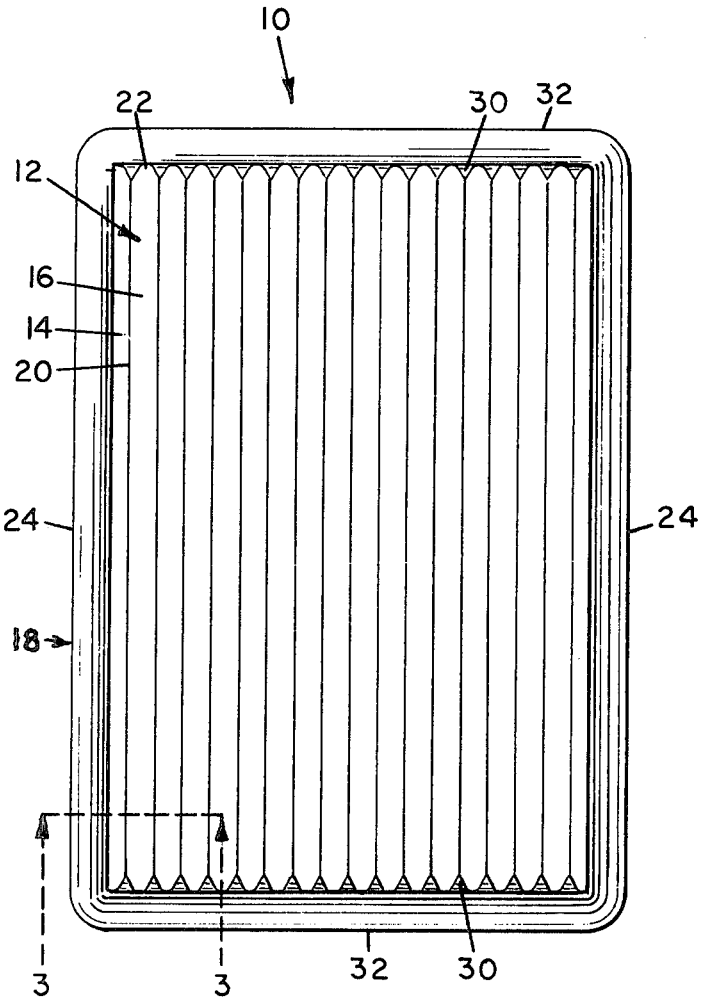
FIG. 1 is an elevational view of the washboard surface of this invention.
Figure 2:
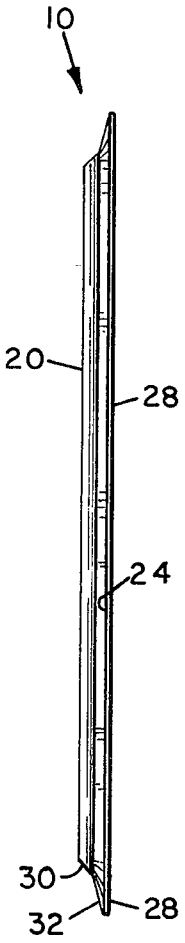
FIG. 2 is a side edge view of FIG. 1.
Figure 3:
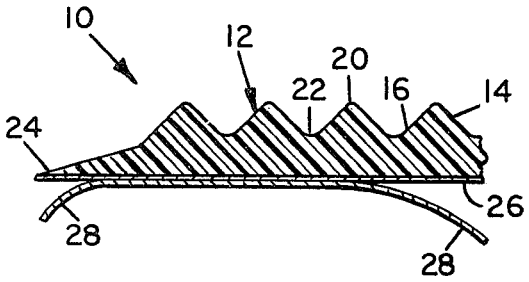
FIG. 3 is a sectional view, on an enlarged scale, on line 3—3 of FIG. 1, showing the feathered edge in detail.

There is shown at 10 the washboard sheet of this invention, here shown as being rectangular in outline, but which may be made in various shapes and sizes, depending on the size and type of basin to which it is to be applied. This sheet 10 may be made of any suitable semi-rigid material, such as high density plastic, examples of which are polyurethane, polyvinyl, semi-hard rubber, etc., so long as the material is capable of being slightly bent or curved to fit on and be secured to a wall of a basin, which wall may be in a single flat plane or may be somewhat rounded or curved surface.

The sheet 10, as shown, has a washboard front surface 12 consisting of corrugations of alternate ridges 14 and furrows 16, and usually extend parallel to the longer edge 18 of the sheet 10. The peaks 20 of the ridges 14 are rounded somewhat as shown, and the furrows 16 are likewise rounded to valleys as at 22 so that the clothing being washed thereover will readily slide thereover without abrading or snagging. The exact angle of the corrugations 12 may be provided as desired, and the ends of the ridges 14 slope from the peaks 20, as shown at 30, to the side feathered edges 32.

In most cases, the corrugations 14, 16 run parallel to the long edge 18 of the sheet 10, the sheet 10 here being shown as rectangular in outline, but, depending on the particular basin for which it is intended, the shape and size may be varied as desired for the particular usage. All of the edges 18, but at least the edges parallel to the corrugations 14, 16, are feathered as at 24 to a fine edge, so that when the sheet 10 is permanently attached to the wall of the basin on which it is to be used, the clothing will readily slide onto and off of the surface of the corrugated sheet 10.

The back surface of the sheet 10 is covered with a high tack adhesive surface 26 of any suitable conventional material, and a conventional peelable protective cover sheet 28 covers the high-tack surface 26 until the user desires to apply it permanently to a basin wall.

OPERATION OF THE INVENTION

In operation, the expectant user procures a washboard sheet from a suitable source, a hardware store, supermarket or the like, and then places the sheet 10 permanently on the selected wall of the basin on which it is to be applied. It is applied by peeling off the backing protective sheet 28, exposing the high-tack back surface 26 which is then stuck on the basin wall to which it is thereby permanently attached. Then the article of clothing is rubbed over the corrugations 12, a suitable soap or detergent and water having been provided in the basin. Due to the corrugations 12, the clothing will be caused to release the dirt therein or thereon to the soap and water, after which the clothing is rinsed and suitably dried, as being hung up to dry, and, if done in the evening, the clothing is usually dry by morning, at least, when it is of the material usually used in intimate clothing.

The term "washboard surface" as used herein includes any surface, wrinkled or otherwise, of elevations and valleys, regular as in corrugations or irregular as in randomly spaced hills and valleys or randomly spaced raised dots on any suitable surface. The term "washboard surface" in this specification and as hereinafter claimed is thereby defined in accordance herewith.

Although this invention has been described in some detail, such description is intended as being illustrative rather than limiting, since the invention may be variously embodied within the scope of what is claimed.

Having thus set forth and disclosed the nature of this invention, what is claimed is:

1. A readily, permanently attachable washboard surface sheet for a wall of a washbasin, washtub, and the like, comprising a somewhat flexible sheet (10), means for attaching the backwall of said sheet (10) to the basin or tub wall, said sheet having a washboard surface (12) over which clothing items may be rubbed in a cleansing action, said washboard surface comprising a plurality of parallel, spaced apart ridges (14) and furrows (16), said ridges having rounded peaks (20) and said furrows having rounded valleys (22), a basin wall permanently self-attaching high-tack adhesive material on said backwall of said washboard sheet (10), and a readily peelable protective cover sheet (28) on said high-tack adhesive material (26), said washboard sheet (10) being composed of semi-rigid high density plastic material, the ends of said ridges and furrows being sloped (30) to a feathered short side sheet edge (32), said sheet having a feathered long thin edge (24) terminating substantially in the plane of said backwall, said long thin edge being parallel to said ridges and and furrows to attach to the basin or tubwall, whereby the item of clothing being cleansed thereover will slide smoothly over said long thin feathered edge onto said washboard surface and over said ridges and furrows.

* * * * *